US005730571A

United States Patent [19]

Rinaudo

[11] Patent Number: 5,730,571

[45] Date of Patent: Mar. 24, 1998

[54] APPARATUS FOR BINDING DOCUMENTS UTILIZING SLIP BINDERS

[75] Inventor: George Rinaudo, North Stonington, Conn.

[73] Assignee: Gunther International, Ltd., Norwich, Conn.

[21] Appl. No.: 475,521

[22] Filed: Jun. 7, 1995

[51] Int. Cl.[6] ..... B42B 5/06

[52] U.S. Cl. ..... 412/34; 412/33; 412/9

[58] Field of Search ..... 412/9, 18, 20, 412/33, 34, 39, 40, 42, 43

[56] References Cited

U.S. PATENT DOCUMENTS 5,226,771 7/1993 Gardner ..... 412/6
5,364,216 11/1994 Mandel ..... 412/34

FOREIGN PATENT DOCUMENTS 2619053 2/1989 France ..... 412/34

*Primary Examiner*—Willmon Fridie, Jr.
*Attorney, Agent, or Firm*—Ware, Fressola, Van Der Sluys & Adolphson LLP

[57] ABSTRACT

An apparatus for binding documents utilizes generally U-shaped or C-shaped resilient slip binders. A hopper device feeds the slip binders from its reservoir to a buffer conveying device which supplies an insertion module with the slip binders. The binding apparatus is design for use in a high speed electronic publishing system.

45 Claims, 14 Drawing Sheets

APPARATUS FOR BINDING DOCUMENTS UTILIZING SLIP BINDERS

BACKGROUND OF THE INVENTION

1. Field of the Invention

The present invention relates to an apparatus for binding paper documents and, more particularly, to an apparatus for binding paper documents with slip binders.

2. Description of the Prior Art

In the electronic publishing field, multi-page documents such as insurance policies and contracts are printed on high-speed laser printers and then finished on an electronic publishing system which assembles the document and adds any desired inserts (such as prefolded advertising brochures or other solicitations) to the document to create a product and then inserts the product into a standard envelope to create a package ready for mailing. These steps are done at high speed while the accuracy of the document assembly is verified through use of a printed bar code on each sheet of the document.

Heretofore, the document has been bound during the high speed assembling process by means of stapling or a prong-styled thermal sealed binder. One of the drawbacks of these binding systems is that they are inconvenient if the document has to be disassembled, e.g., if another page has to later be inserted therein.

The present invention is designed to overcome the above limitations that are attendant upon the use of "prior art" devices, and toward this end, it contemplates the provision of a novel apparatus for binding in a document which utilizes a generally U-shaped or C-shaped slip binder.

It is an object of the present invention to provide an apparatus utilizing a hopper device for the slip binders which automatically aligns and feeds the slip binders for insertion on the document.

It is also an object to provide such an apparatus utilizing a device which receives the slip binders from the hopper device and positions the binder to bind the document.

Yet another object is to provide an apparatus which accomplishes the desired binding format at high speeds.

A further object is to provide an apparatus that is compatible with conventional electronic publishing systems and is generally compatible in physical size, form and configuration with "prior art" devices, to be readily adaptable for the same use without disadvantage.

It is a general aim of the invention to provide such an apparatus which may be readily and economically fabricated and will have long life in operation and significantly greater flexibility in use.

SUMMARY OF THE INVENTION

It has now been found that the foregoing and related objects can be readily attained in a binding apparatus made in accordance with the present invention which facilitates the binding documents, each composed of a stack of sheets. The binding apparatus includes a conveying device for delivering, from a plurality of resilient slip binders, one sequentially delivered slip binder at a time and an insertion device for receiving each sequentially delivered slip binder from the conveying device and inserting each sequentially delivered slip binder on its associated document.

According to the invention, the inserting device comprises a spreading device for opening each sequentially delivered slip binder to permit insertion thereof on its associated document and an inserter for relatively moving each sequentially delivered slip binder and its associated document to insert the sequentially delivered slip binder thereover. The spreading device includes two opposed blades positionable in a slip binder receiving position for receiving each sequentially delivered slip binder thereover from the conveying device and means to move the opposed blades relative to each other into a slip binder insertion position thereby opening the sequentially delivered slip binder to permit insertion thereof over its associated document. The insertion device separates the opposed blades from the sequentially delivered slip binder following insertion of the sequentially delivered slip binder on its associated document by the inserter whereby the sequentially delivered slip binder binds its associated document. Following binding, the opposed blades return to the slip binder receiving position to receive the next sequentially delivered slip binder.

Desirably, the insertion device has a clamping device which cooperates with the opposed blades for holding the sequentially delivered slip binder during operation of the inserter. The clamping device has two relatively moveable opposed clamping jaws which engage the sequentially delivered slip binder.

Conveniently, the inserter includes a document handler for relatively moving each sequentially delivered slip binder and its associated document. The document handler includes a pusher device for relatively moving each sequentially delivered slip binder and its associated document to insert the sequentially delivered slip binder over an edge of its associated document. The pusher device has a document clamp for holding the document to be bound following insertion of the sequentially delivered slip binder thereon. The document handler also includes a moveable support for supporting at least a portion of the document to be bound. The moveable support is positioned to support the edge of the document which is to receive the sequentially delivered slip binder.

In a further feature of the invention, the conveying device has a hopper device for feeding the plurality of resilient slip binders one sequentially delivered slip binder at a time to a buffer conveyor which transfers each sequentially delivered slip binder to the insertion device. The hopper device operates to move a sequentially delivered slip binder to the buffer conveyor upon delivery of a sequentially delivered slip binder to the insertion device by the buffer conveyor. The hopper device provides a reservoir for the plurality of resilient slip binders and a rotary drum for feeding one sequentially delivered slip binder at a time from the reservoir to the buffer conveyor. The rotary drum is provided with an orientation slot therein into which one sequentially delivered slip binder at a time can orientate itself from the reservoir for delivery to the buffer conveyor. Located adjacent to the rotary drum is an abutment plate for preventing delivery of an incorrectly orientated slip binder from the orientation slot to the buffer conveyor and a diverter for transferring each correctly orientated sequentially delivered slip binder from the orientation slot to the buffer conveyor. The diverter defines a chute for guiding each sequentially delivered slip binder from the orientation slot to the buffer conveyor.

In the invention, the buffer conveyor includes a buffer device for temporarily storing at least two sequentially delivered slip binders to await delivery to an incrementally driven conveyor which transfers each sequentially delivered slip binder to the insertion device. The buffer device has a pusher for moving each sequentially delivered slip binder between first, second and third buffer positions and from the third buffer position to the incrementally driven conveyor. The first buffer position is located on the pusher and the pusher is reciprocally driven to permit each sequentially delivered slip binder to fall from the pusher so the pusher can move each sequentially delivered slip binder to the second and third buffer positions and to the incrementally driven conveyor. The pusher moves a sequentially delivered slip binder in the third position to the incrementally driven conveyor upon delivery of a sequentially delivered slip binder to the insertion device by the incrementally driven conveyor.

The buffer conveyor also includes a cross slide assembly for moving each sequentially delivered slip binder from the incrementally driven conveyor to the inserting device. The cross slide assembly has a reciprocally driven pusher block for engaging each sequentially delivered slip binder and moving each sequentially delivered slip binder laterally to the spreading device of the insertion device on its two opposed blades in their slip binder receiving position.

The invention will be fully understood when reference is made to the following detailed description taken in conjunction with the accompanying drawings.

DETAILED DESCRIPTION OF THE INVENTION

Figure 1:
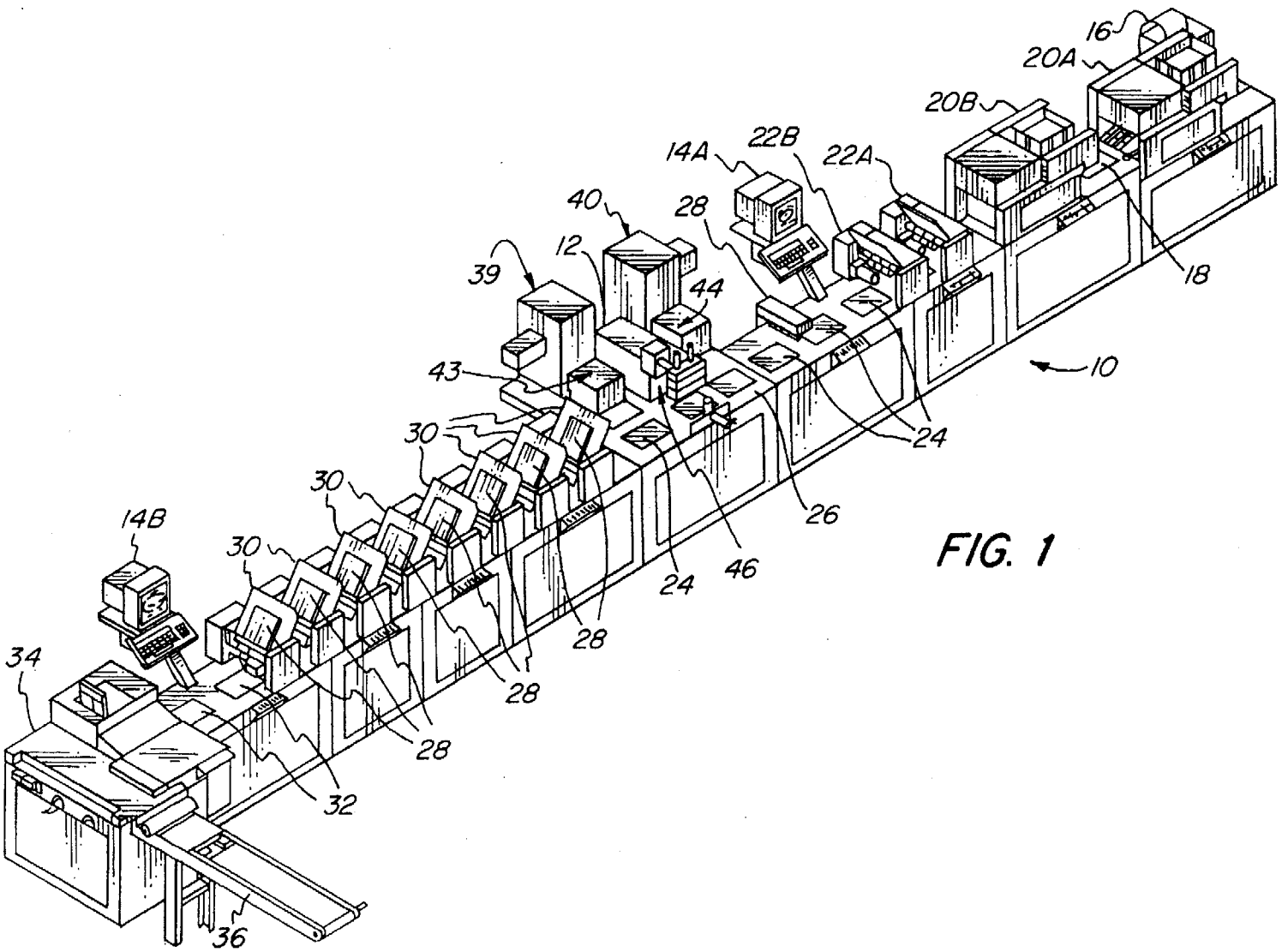
FIG. 1 is a perspective view of an electronic publishing system which utilizes the slip binder module of the present invention.

Turning first to FIG. 1 of the drawings, therein illustrated is an electronic publishing system generally designated by the numeral 10 which utilizes a slip binder module 12 made in accordance with the present invention. A computer processing unit (not shown) including two keyboard/monitor units 14A,14B allows the user to track the operation of the electronic publishing system 10. The electronic publishing system 10 has a log printer 16 which keeps track of the operation of the electronic publishing system 10 including hourly rate, errors, etc.

Sheets to be fed are placed into a pair of primary document feeders 20A,20B. The document feeders 20A,20B separate the sheets into individual stacks 18 and introduce the stacks 18 to a pair of cover feeders 22A,22B. For example, the stacks 18 could be individual insurance policies. Each sheet in each assembled stack 18 of sheets has a bar code printed thereon to verify the accuracy of its assembled stack 18. Bar code readers and sensors (not shown) are appropriately located throughout the electronic publishing system 10 so the computer processing unit can monitor each stack 18 of sheets as it proceeds through the electronic publishing system 10. The pair of cover feeders 22A,22B feed front and back covers to the stacks 18 to form documents 24. The documents 24 are transferred onto a high-speed conveyor system 26 which transports the documents 24 either for stapling by a stapler 28 or for binding by the slip binder module 12 in a manner to be explained further hereinafter. The user can choose whether a document 24 is to be stapled or bound through use of the computer processing unit or the computer processing automatically chooses stapling or binding based on various factors, e.g., the number of sheets in the document. The stapled or bound documents 24 are then transferred by the high speed conveyor system 26 to a plurality of insert feeders 30 spaced above the high speed conveyor system 26 for feeding inserts 28 onto the stapled or bound documents 24 to create products 32. The computer processing unit controls the operation of the insert feeders 30 and signals them to feed the appropriate insert(s) 28 in accordance with the specific needs of documents 24 passing underneath. Thereafter, the products 32 are inserted into envelopes at an enveloper 34 to create packages (not shown). The packages proceed onto a slowly indexed conveyor 36 where the packages are aligned in a shingled manner ready to be mailed.

Figure 2:
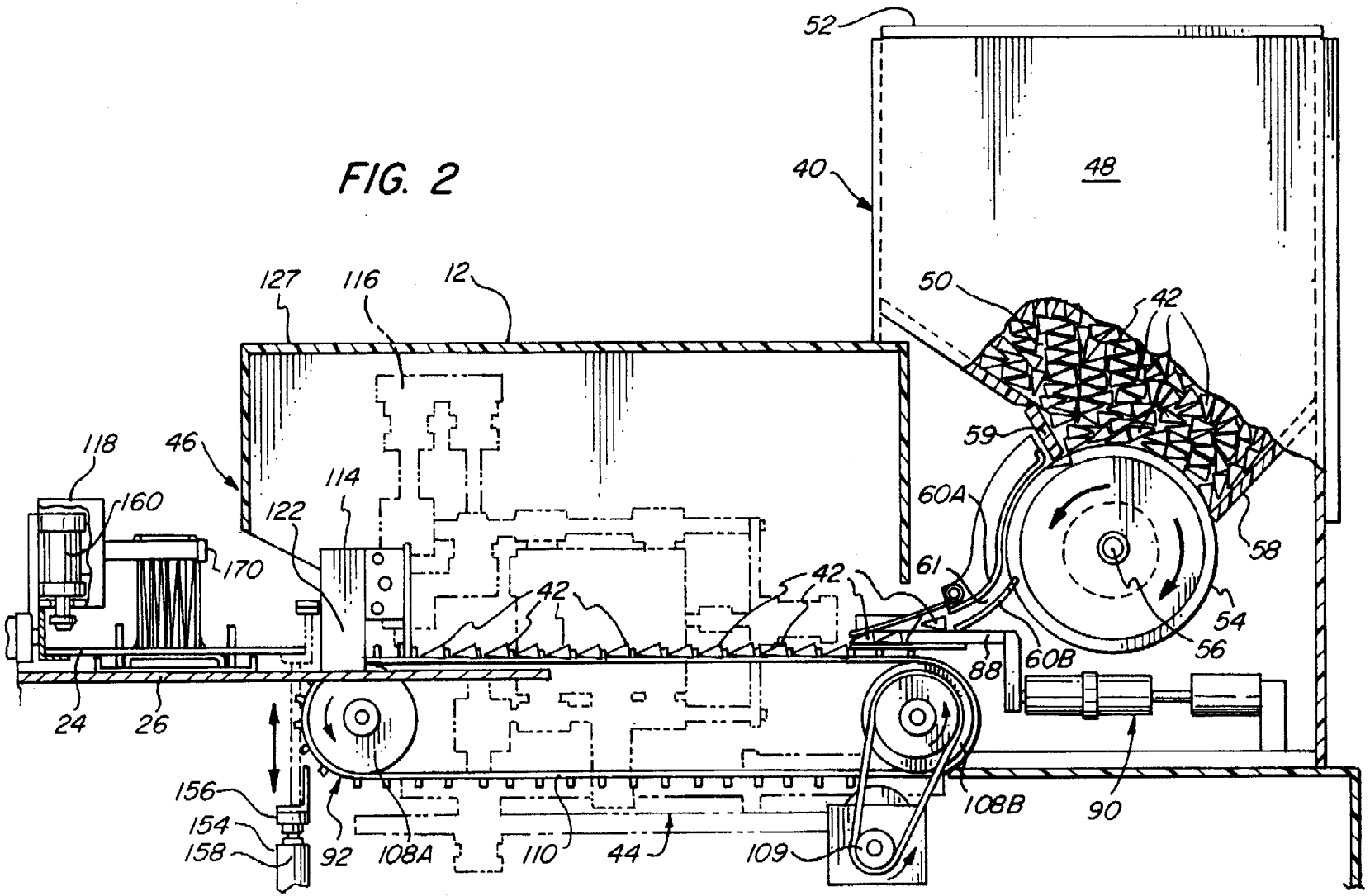
FIG. 2 is a side elevational view of the slip binder module of the present invention with parts of the housings broken away to illustrate internal structure and with some of the drive mechanism in dotted line to show its relative position.
Figure 3:
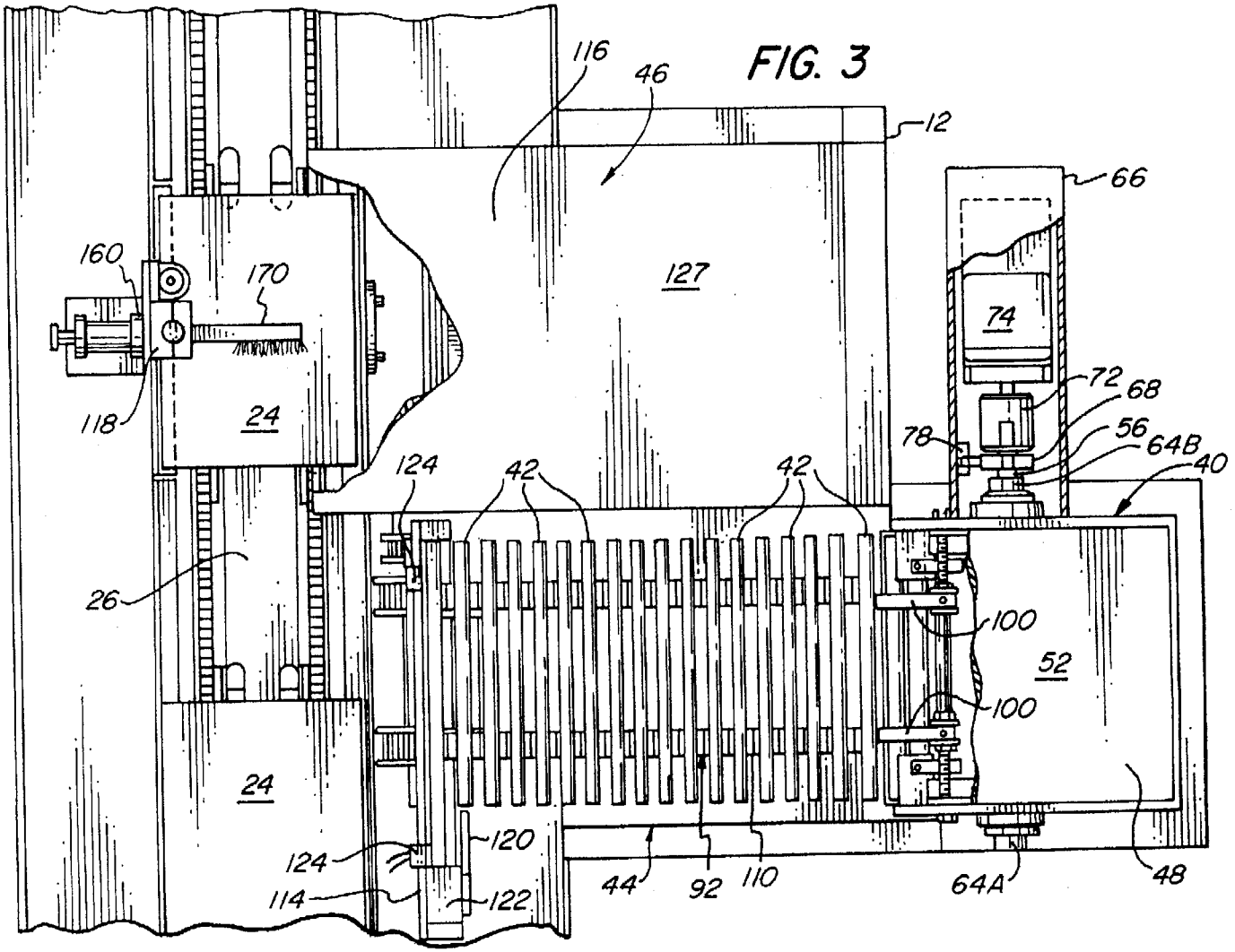
FIG. 3 is a top plan view of the binding apparatus of the present invention with portions of the housing broken away to illustrate internal structure.

Turning now to FIGS. 2 and 3 taken in conjunction with FIG. 1, the slip binder module 12 of the present invention has two hopper devices generally indicated by the numerals 39,40 for orientating slip binders 42. Each hopper device 39,40 feeds the slip binders 42 to its associated buffer conveying device generally indicated by the numerals 43,44 for supplying a centrally located insertion module generally indicated by the numeral 46. The two hopper devices 39,40 and their associated buffer conveying devices 43,44 are essentially identical in design and function except they feed different size slip binders 42 from different sides of the centrally located insertion module 46, i.e., one hopper device 39 feeds slip binders capable of holding up to sixty (60) sheets of paper from the left side of the centrally located insertion module 46 while the other hopper device 40 feeds slip binders capable of holding up to forty (40) sheets of paper from the right side of the centrally located insertion module 46. The slip binders 42 are well known binding devices which are made from a resilient plastic material and have generally a U-shaped or C-shaped cross-section. The length of the slip binder 42 generally corresponds to the length of the side of the document 24 to bound and its resilient nature binds the sheets of the document 24 securely. The use of the slip binders 42 is advantageous since they can be readily removed so the documents bound thereby can be easily disassembled as needed. Slip binders 42 also provide a very economical binding system.

Since the two hopper devices 39,40 and their associated buffer conveying devices 43,44 are essentially identical except for the size of the slip binder 42 being fed and the direction of feeding, only the hopper device 40 and its associated buffer conveying device 44 on the right side of the insertion module 46 will be explained in detail. The hopper device 40 includes a hopper cabinet 48 forming a reservoir 50 for the slip binders 42. The reservoir 50 holds approximately twelve hundred (1200) slip binders 42 which represent a supply for about an hour of operation of the electronic publishing system 10. The hopper cabinet 48 has a removable cover 52 which permits the user to load a plurality of slip binders 42 into the reservoir 50. It should be noted that the slip binders 42 in the reservoir 50 are randomly orientated. In order to properly orientate the slip binders 42 for delivery to the buffer conveying device 44, the hopper device 40 is provided with a feeding drum 54 fixedly mounted on a rotatable shaft 56 within the hopper cabinet 48. The feeding drum 54 is positioned adjacent to a resting plate 58, an abutment plate 59 and a pair of diverters 60A,60B which form a chute 61 therebetween. Extending across at least a portion of the periphery of the feeding drum 54 in the axial direction is an orientation slot 62 having a cross-sectional profile essentially matching the cross-sectional profile of the slip binders 42. As will be explained further hereinafter, individual ones of the slip binders 42 can drop into the orientation slot 62 adjacent to the resting plate 58 to be fed to the buffer conveying device 44. The feeding drum 54 also has a pair of circumferential diverter grooves 63 into which the diverter 60B extends.

Figure 4:
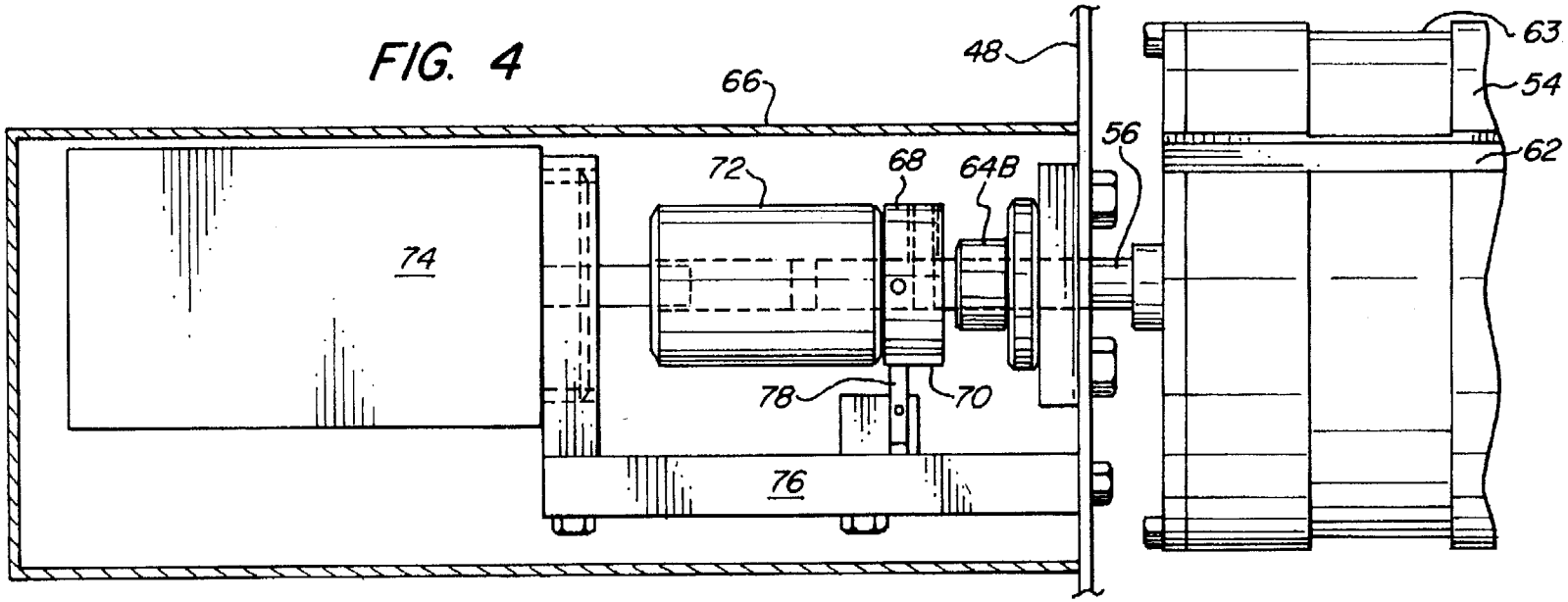
FIG. 4 is a side elevational view of the drive mechanism for the hopper device.
Figure 5A:
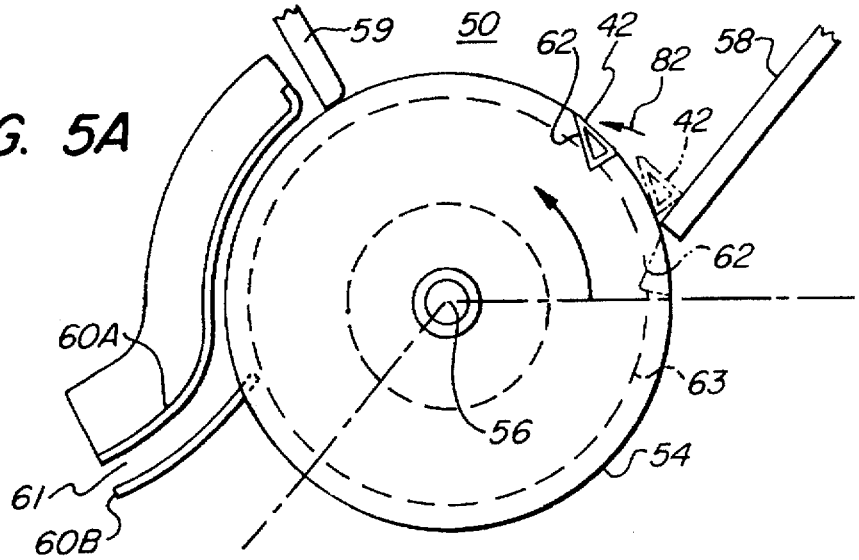
FIGS. 5A–5C are schematic diagrammatic side elevational views showing the sequence of operation of the hopper device showing a slip binder orientated in the correct position for feeding the slip binder to the buffer conveying device.
Figure 5B:
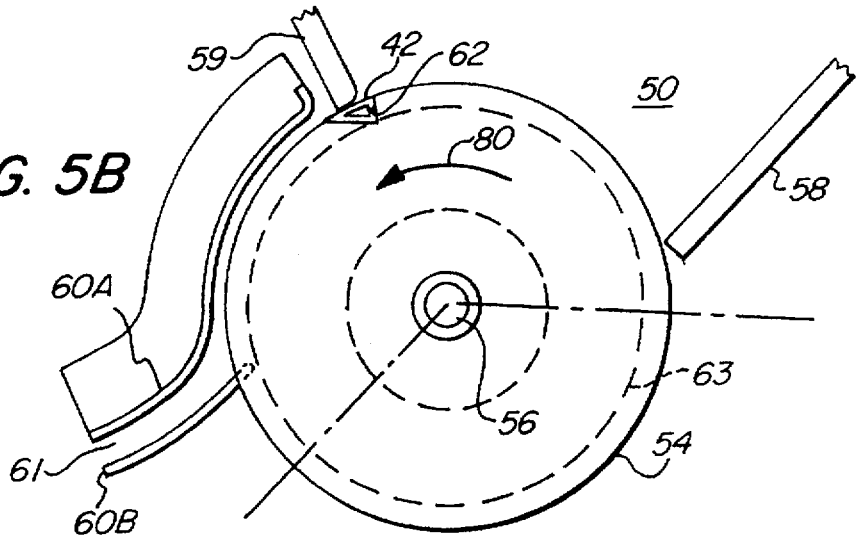

Referring to FIGS. 3 and 4, the rotatable shaft 56 extends through the hopper cabinet 48 into a bearing 64A exteriorly mounted on the hopper cabinet 48 and also extends through a bearing 64B within a hopper motor housing 66. From the bearing 64B in the hopper motor housing 66, the rotatable shaft 56 continues to extend through a timing disk 68 having a magnetic timing plate 70 thereon and then terminates in a one-way slip clutch 72. Operationally connected to the other end of the slip clutch 72 is a reversible servo motor 74 secured to a motor bracket 76 extending from the hopper cabinet 48. The motor bracket 76 is also used to orientate a proximity switch 78 adjacent the timing disk 68 for controlling the operation of the reversible servo motor 74 and thus the feeding drum 54 operationally connected thereto. The proximity switch 78 controls the angular rotation of the reversible servo motor 74 and the feeding drum 54 operationally connected thereto so as to cycle the orientation slot 62 between a start position (shown in phantom line in FIG. 5A) just below the resting plate 58 to a finish position (shown in phantom line in FIG. 5A) just below the diverter 60B.

Figure 5C:
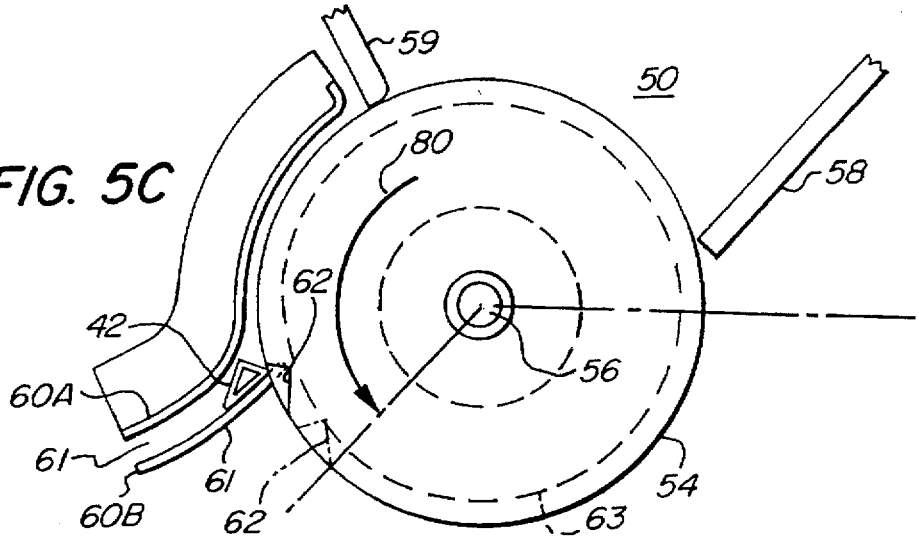

As seen in FIGS. 5A–5C and 6A–6C, a slip binder 42 in the reservoir 50 can randomly orientate itself against the resting plate 58 in the correct position (phantom line in FIG. 5A) for delivery to the buffer conveying device 44 with its open edge as its leading edge or the incorrect position (phantom line in FIG. 6A) with its closed edge as its leading edge. With the slip binder 42 in the correct position (phantom line in FIG. 5A), the feeding drum 54 with the orientation slot 62 in the start position (phantom line in FIG. 5A) rotates counterclockwise as shown by arrow 80 driven by the reversible servo motor 74 whereby the slip binder 42 adjacent to the resting plate 58 drops into the orientation slot 62 as indicated by arrow 82 as the orientation slot 62 passes the resting plate 58. The feeding drum 54 continues to rotate the slip binder 42 in the orientation slot 62 past the abutment plate 59 (FIG. 5B) and to the diverters 60A,60B where the slip binder 42 engages the diverter 60B in the diverter grooves 63 to dislodge the slip binder 42 into the chute 61 where it falls to the buffer conveying device 44 as shown in FIG. 5C. The feeding drum 54 continues to rotate under the influence of the reversible servo motor 74 to the finish position for the orientation slot 62 (phantom line in FIG. 5C). The reversible servo motor 74 is controlled to rotate through a specified angle of rotation between the start and finish positions. Thereafter, the reversible servo motor 74 reverses direction driving the feeding drum 54 in the clockwise direction until the orientation slot 62 reaches its start position (phantom line in FIG. 5A) where it is stopped under the control of the interaction of the timing disk 68, magnetic timing plate 70 and proximity switch 78 so as to be ready to feed the next slip binder 42 adjacent to the lower end of the resting plate 58.

Figure 6A:
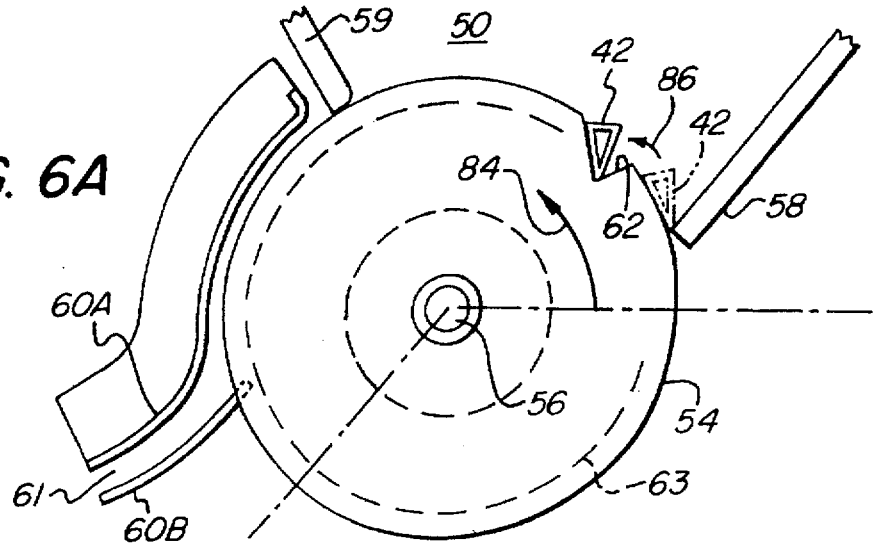
FIGS. 6A–6C are schematic diagrammatic side elevational views similar to FIGS. 5A–5C but showing a slip binder orientated in the incorrect position for feeding the slip binder to the buffer conveying device.
Figure 6B:
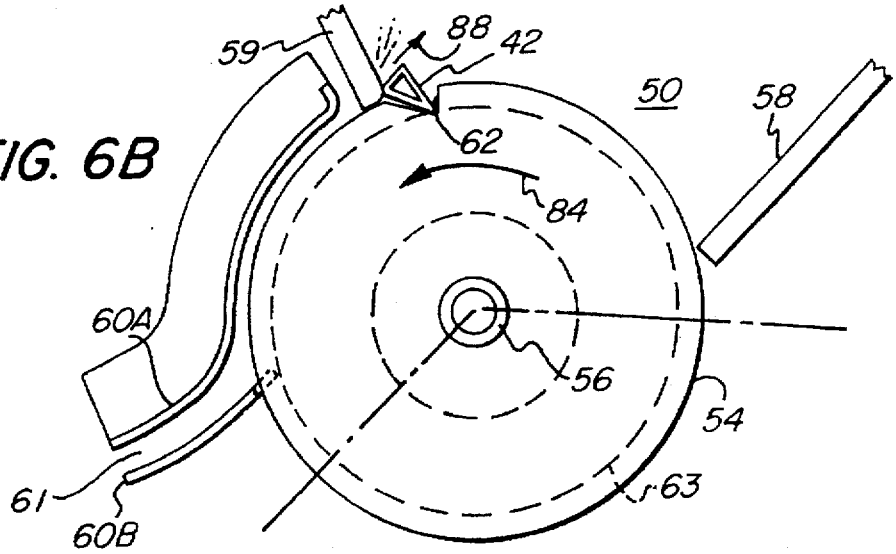
Figure 6C:
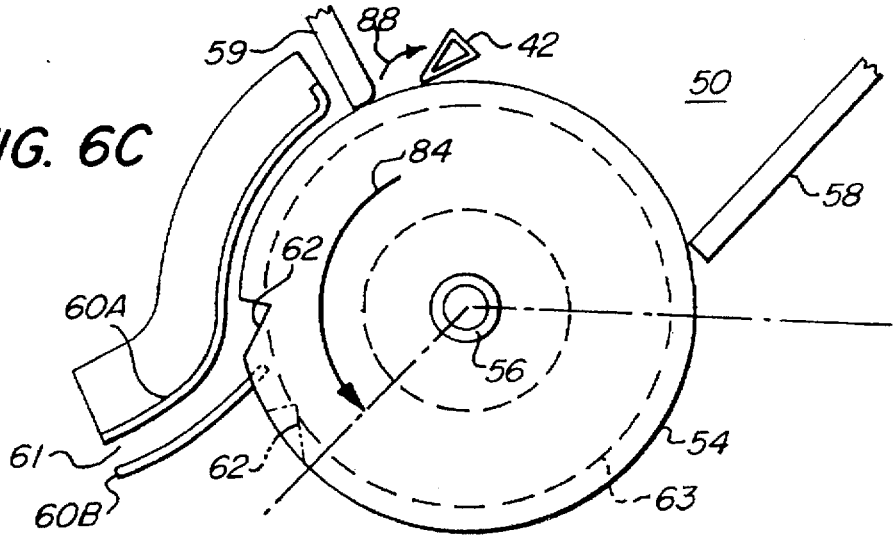

If the slip binder 42 is in the incorrect position (phantom line in FIG. 6A), the feeding drum 54 with the orientation slot 62 in the start position (phantom line in FIG. 6A) rotates counterclockwise as shown by arrow 84 whereby the slip binder 42 adjacent the resting plate 58 drops into the orientation slot 62 as indicated by an arrow 86 as the orientation slot 62 passes the resting plate 58. The feeding drum 54 continues to rotate the slip binder 42 in the orientation slot 62 toward the abutment plate 59 (FIG. 6B). Because of its incorrect orientation, the slip binder 42 engages the abutment plate 59 and dislodges from the orientation slot 62 as shown by an arrow 88 thereby returning to the reservoir 50. The feeding drum 54 continues to rotate under the influence of the reversible servo motor 74 to the finish position for the orientation slot 62 (phantom line in FIG. 6C). Thereafter, the reversible servo motor 74 reverses direction driving the feeder drum 54 in the clockwise direction until the orientation slot 62 reaches its start position (phantom line in FIG. 6A) where it is stopped under the control of the interaction of the timing disk 68, magnetic timing plate 70 and proximity switch 78 so as to be ready to feed another slip binder 42. Although not illustrated, it is possible that the engagement of the incorrectly orientated slip binder 42 with the abutment plate 59 will cause the feeding drum 54 to jam if the slip binder 42 does not disengage from the orientation slot 62. In this case, the slip clutch 72 permits the reversible servo motor 74 to continue to rotate to the finish position while the feeding drum 54 remains stationary with the orientation slot 62 adjacent to the abutment plate 59. When the reversible servo motor 74 finishes its angular rotation and reaches the finish position, the reversible servo motor 74 reverses thereby driving the feeding drum 54 in the clockwise direction until the orientation slot 62 reaches its start position (phantom line in FIG. 6A) where it is stopped under the control of the interaction of the timing disk 68, magnetic timing plate 70 and proximity switch 78 and is ready to feed another slip binder 42.

Referring now to FIG. 7 and 8A–8L, for purposes of explanation, the slip binders 42 in these figures have been labelled with an additional reference letter (A, B, C, etc.) so their sequencing can be easily understood. However, the numeral 42 will still be used to designate the slip binders in a generic sense. Once the slip binder 42F is fed from the hopper device 40, the chute 61 guides the slip binder 42F coming from the hopper device 40 to the buffer conveying device 44. The buffer conveying device 44 is used to establish a steady feeding of slip binders 42 to the insertion module 46 even if the hopper device 40 has to cycle a number of times in order to obtain a slip binder 42 in the correct position and deliver a slip binder 42 to the buffer conveying device 44. The buffer conveying device 44 has an L-shaped slidable pusher 88 driven by a pneumatic drive system generally indicated by numeral 90 for transferring the slip binders 42 to an endless belt conveyor system generally indicated by the numeral 92. A horizontal leg 94, upon which the slip binders 42 are initially received from the chute 61, of the slidable pusher 88 is slidably received between a buffer platform 96 and the diverters 60B, stop plate 98 and flexible buffer straps 100. A vertical leg 102 of the slidable pusher 88 is reciprocally driven by three series-connected pneumatic piston-cylinder devices 106A,106B, 106C of the pneumatic drive system 90. Positioned to receive slip binders 42 coming off the buffer platform 96 is the endless belt conveyor 92 which includes a pair of spaced-apart pulleys 108A,108B with an endless drive belt 110 therearound. Pulley 108B is incrementally driven by an drive motor 109 (FIG. 2) to move the slip binders 42 on the endless belt conveyor 92 toward the insertion module 46. The endless conveyor belt 110 has a plurality of indexing fingers against which the slip binders 42 are positioned as they move along the endless belt conveyor 92.

Figure 7:
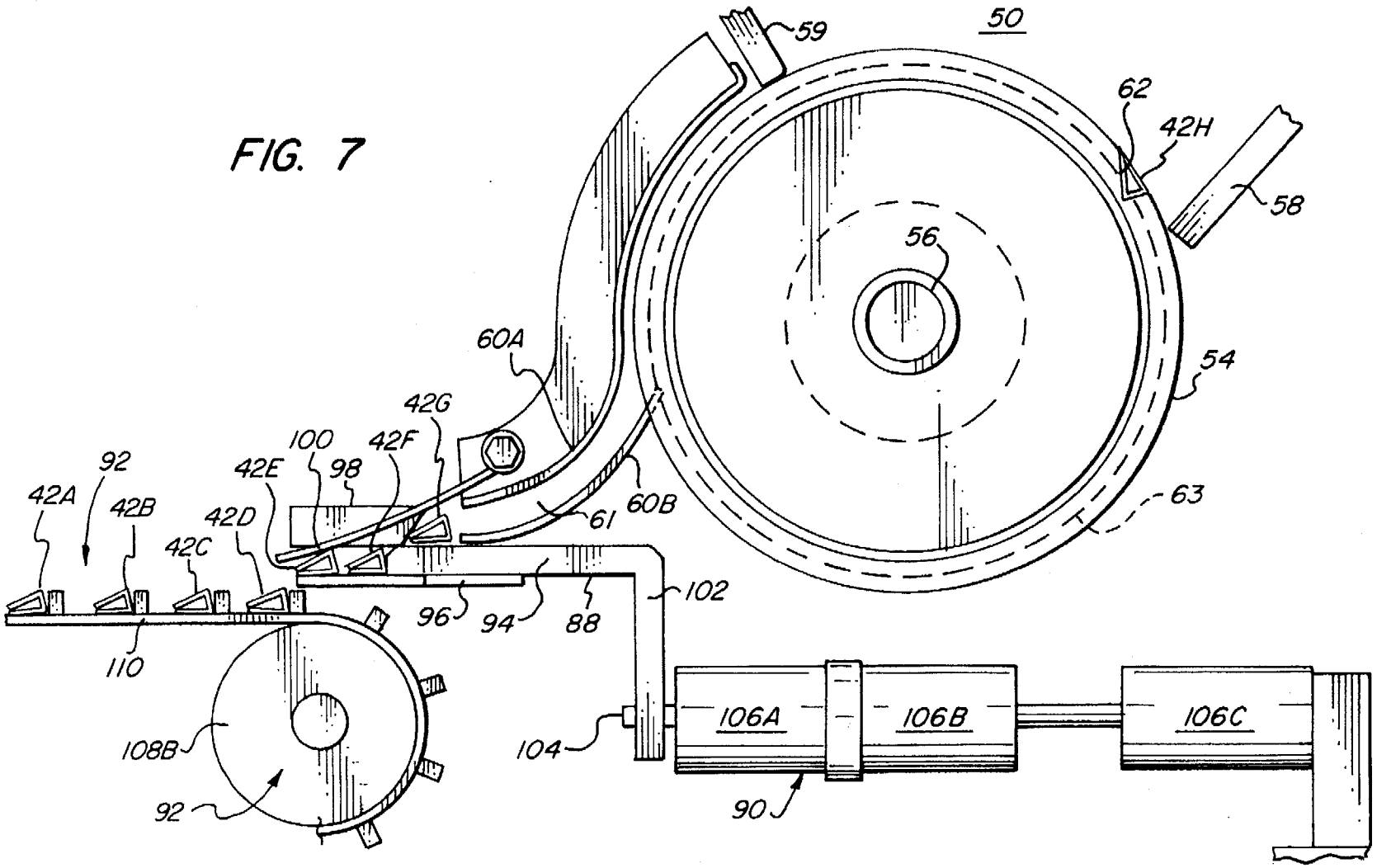
FIG. 7 is a diagrammatic side elevational view showing the relative positions of the hopper device and the buffer conveying device for processing the slip binders.
Figure 8A:
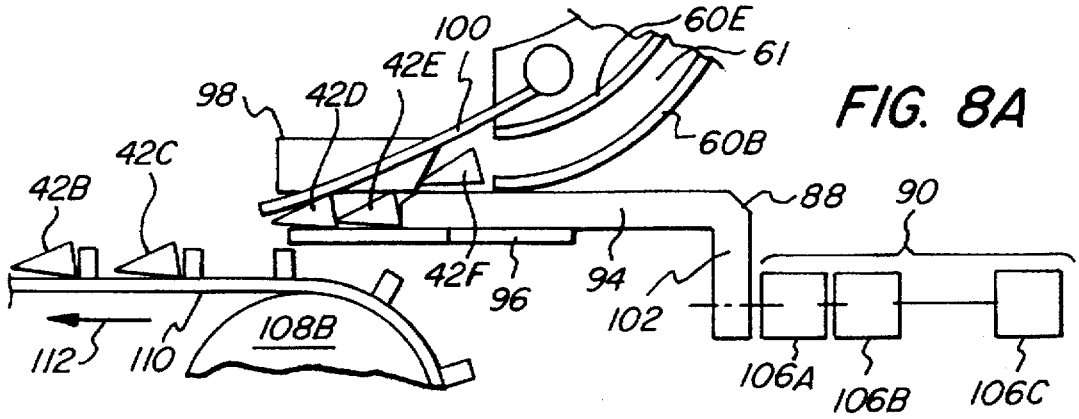
FIGS. 8A–8L are schematic diagrammatic side elevational views showing the sequence of operation of the buffer conveying device for feeding the slip binders.
Figure 8B:
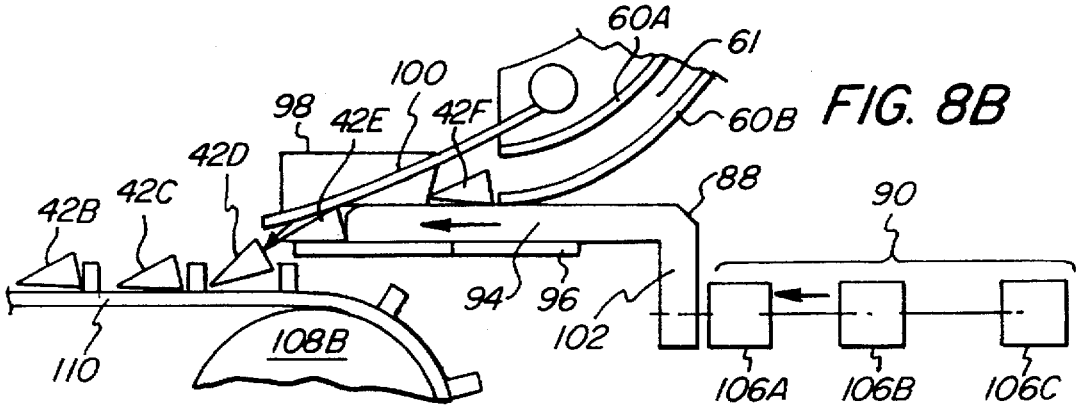
Figure 8C:
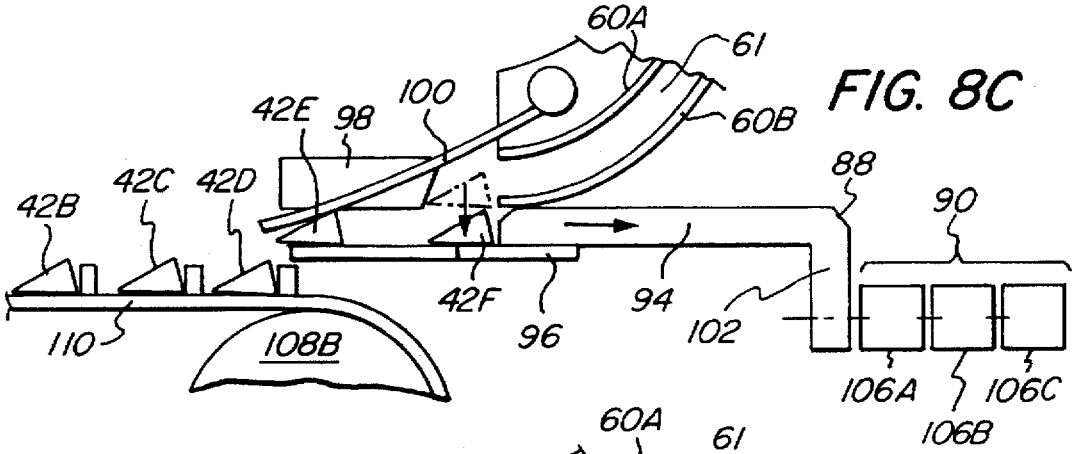
Figure 8D:
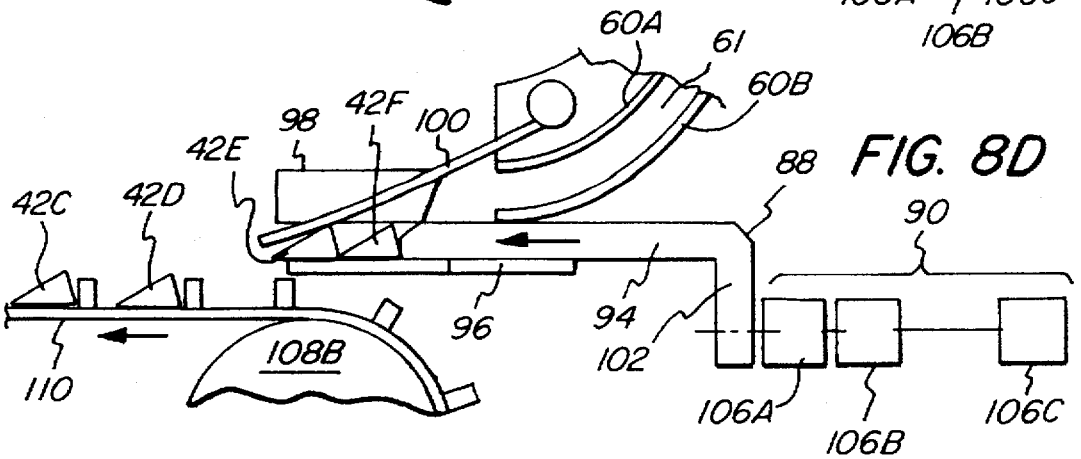
Figure 8E:
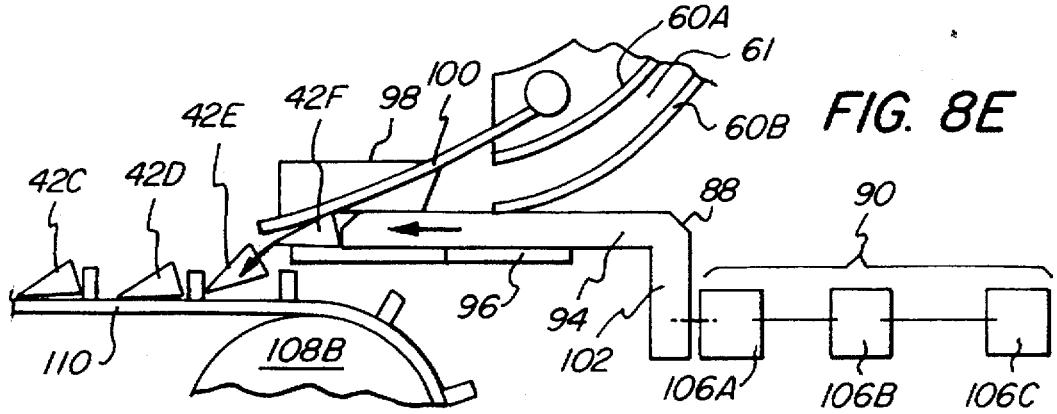
Figure 8F:
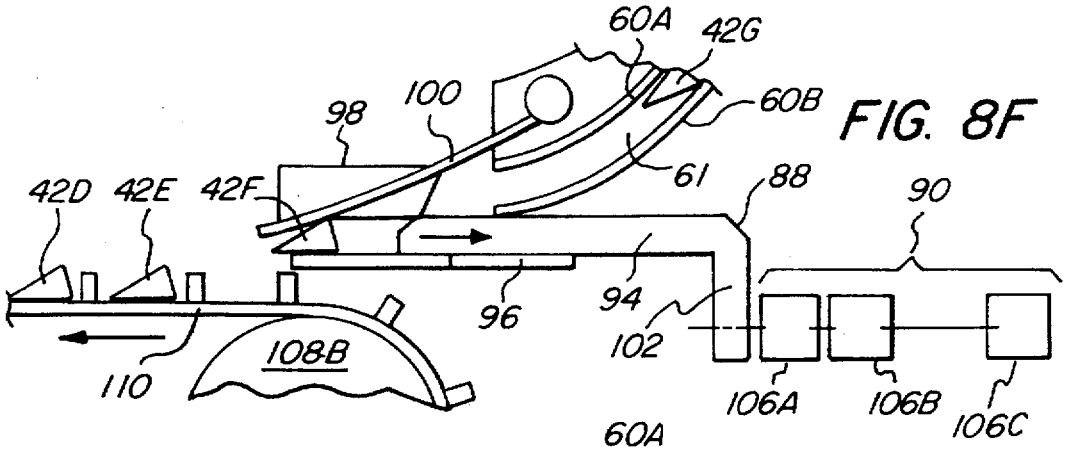
Figure 8G:
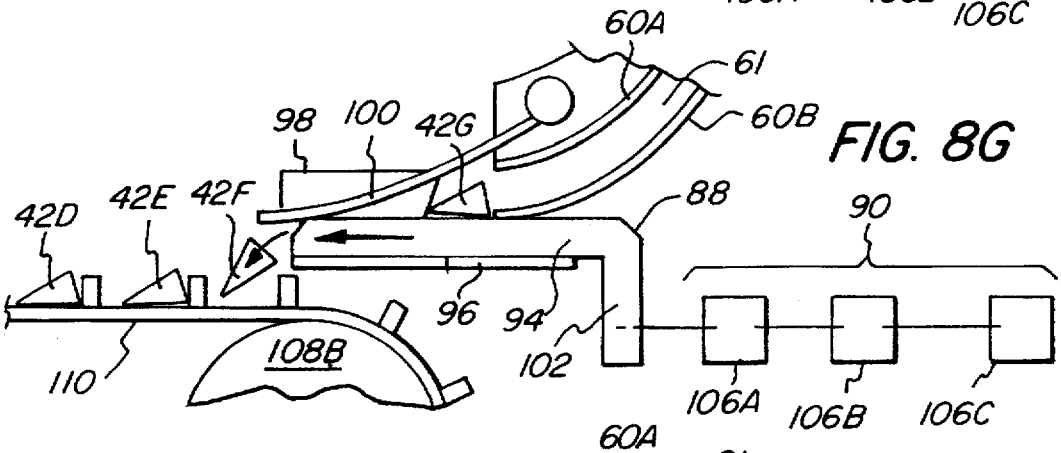
Figure 8H:
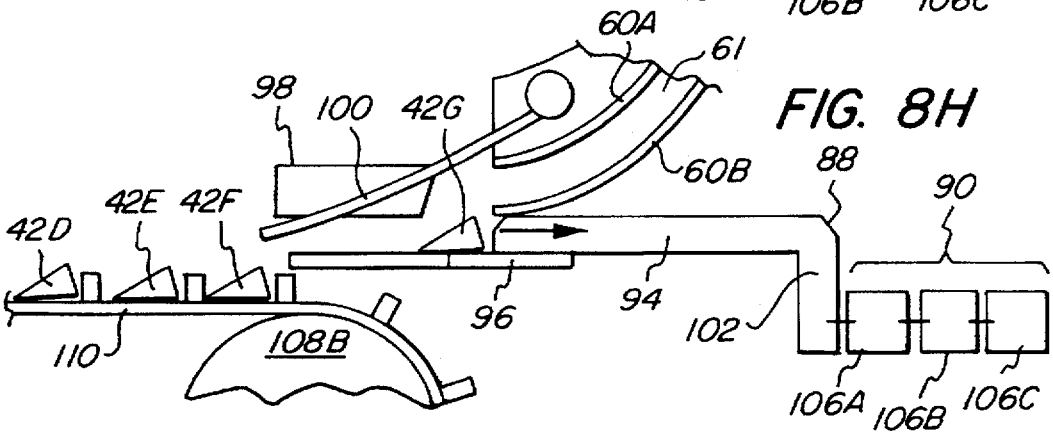
Figure 8I:
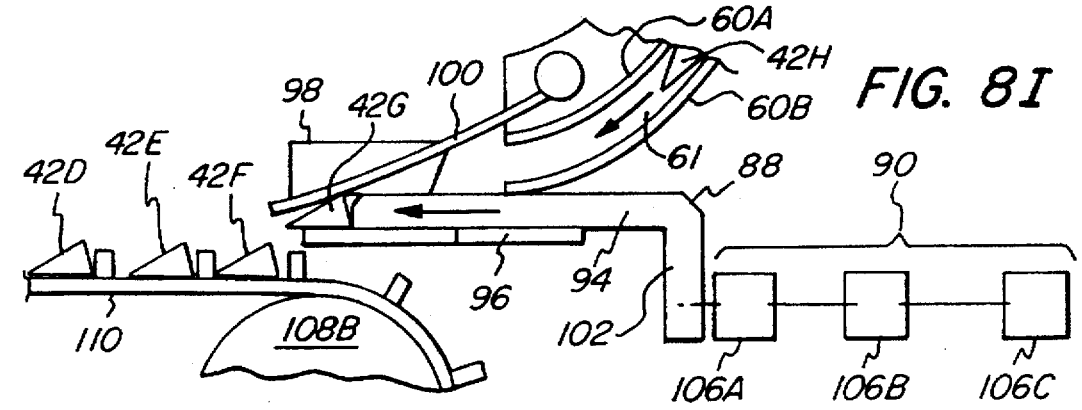
Figure 8J:
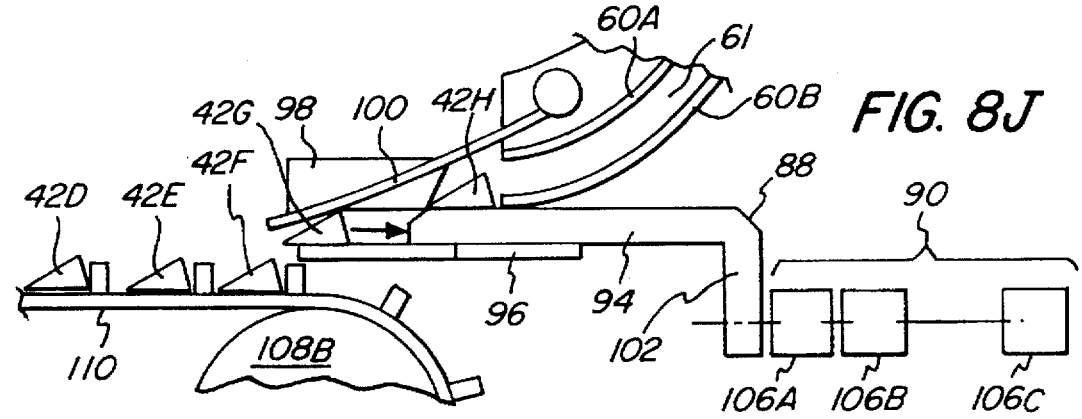
Figure 8K:
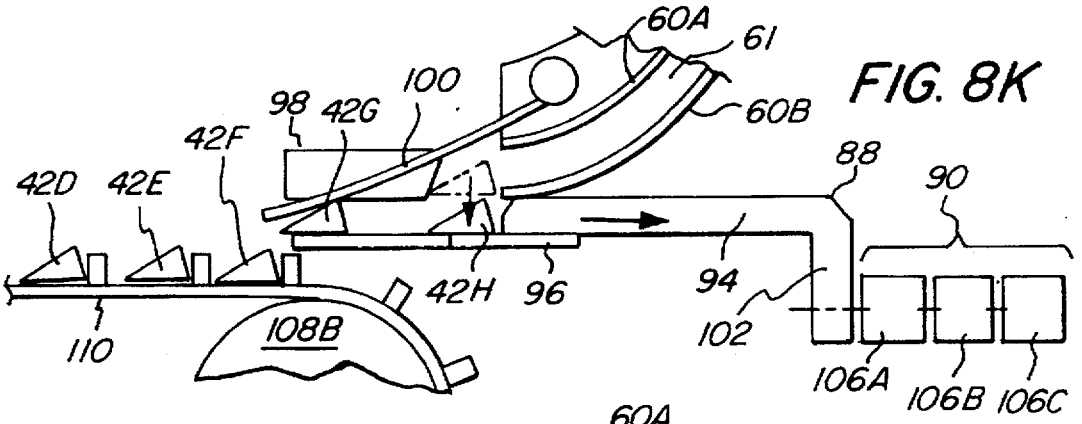
Figure 8L:
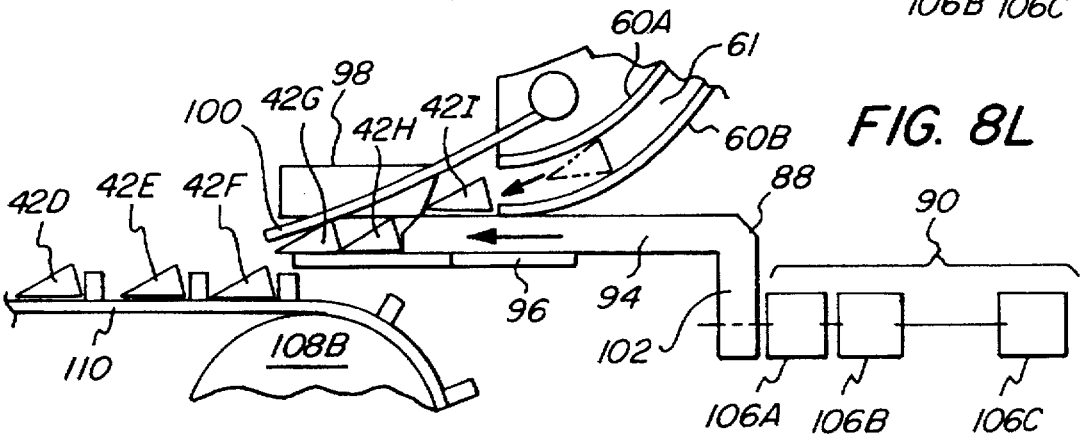

The operation of the buffer conveying device 44 to feed the insertion module 46 can be clearly understood when considering FIGS. 7 and 8A–8L. The buffer conveying device 44 is shown in FIG. 7 fully loaded or buffered with 42F,42E,42D respectively in the first, second and third buffered positions. Appropriate well-known reflective fiber optic sensors (not shown) are located along the endless belt conveyor 92 and at the first, second and third buffered positions along the buffer platform 96 to detect the presence (or absence) of the various slip binders 42 thereon. In FIG. 8A, the endless belt conveyor 92 has just incremented forward as indicated by arrow 112 from its position in FIG. 7 after a slip binder 42 (see FIG. 3), at the end of the endless belt conveyor 92, has been delivered to the insertion module 46 in a manner to be explained further hereinafter. In FIG. 8B, as soon as the absence of a slip binder 42 is detected by the sensor along the endless belt conveyor 92, the pneumatic piston-cylinder device 106B is activated to move the slidable pusher 88 forward to push slip binder 42D from the third buffered position onto the endless belt conveyor 92 and move slip binder 42E forward from the second buffered position to the third buffered position on the edge of the buffer platform 96 where it is held by the resilient buffer straps 100. In FIG. 8C, the slidable pusher 88 is then pulled back under the diverter 60B by the pneumatic piston-cylinder devices 106B,106C thereby permitting slip binder 42F to drop onto the buffer platform 96 from the first to the second buffered positions. The sensor (not shown) in the first buffered position senses the occurrence of this dropping and signals the hopper device 40 to cycle so as to deliver slip binder 42H (FIG. 7) to the chute 61. As previously described with regard to FIGS. 6A–6C, if the slip binder 42H happens to be incorrectly positioned in the orientation slot 62 of the feeding drum 54, it could take several cycles to achieve delivery of a slip binder 42 to the chute 61. In the meantime, the insertion module 46 continues to require slip binders 42 so the pneumatic piston-cylinder device 106C is activated to move the slidable pusher 88 forward to position slip binder 42F in the second buffered position adjacent to slip binder 42E (FIG. 8D) and then the pneumatic piston-cylinder device 106B is activated to move the slip binder 42E onto the endless belt conveyor 92 (FIG. 8E). In FIG. 8F, the endless belt conveyor 92 has incremented forward thereby delivering another slip binder 42 to the insertion module 46 while the pneumatic piston-cylinder device 106C has retracted pulling the slidable pusher 88 back to its initial position as the next slip binder 42G drops down the chute 61 into the first buffered position on top of the buffer platform 96. To move the slip binder 42F to the endless belt conveyor 92 as shown in FIG. 8G when the endless belt conveyor 92 has incremented forward, the pneumatic piston-cylinder devices 106A,106B are activated to move slidable pusher 88 to its fully extended position. All of the pneumatic piston-cylinder devices 106A,106B,106C are then retracted to move the slidable pusher 88 to its fully retracted position to permit the slip binder 42G to fall onto the buffer platform 96 (FIG. 8H). As seen in FIGS. 8I–8L, when the endless belt conveyor 92 is not incrementing forward delivering slip binders 42 to the insertion module 46, the buffer conveying device 44 returns to its fully loaded or buffered condition (FIG. 8L) with slip binders 42I,42H,42G filling the first, second and third buffered positions, respectively. While, at the respective operating rates of the hopper device 40 and insertion module 46, it has been found through testing that having a slip binder module 12 with three buffer positions for the slip binders 42 is sufficient to keep endless belt conveyor 92 fully supplied with slip binders 42 even though the hopper device 40 may have to cycle a number of times to obtain a slip binder 42 in the correct position in the orientation slot 62 for delivery to the buffer conveying device 44, it should be appreciated by those skilled in the art that a larger buffer system could be provided.

Figure 9:
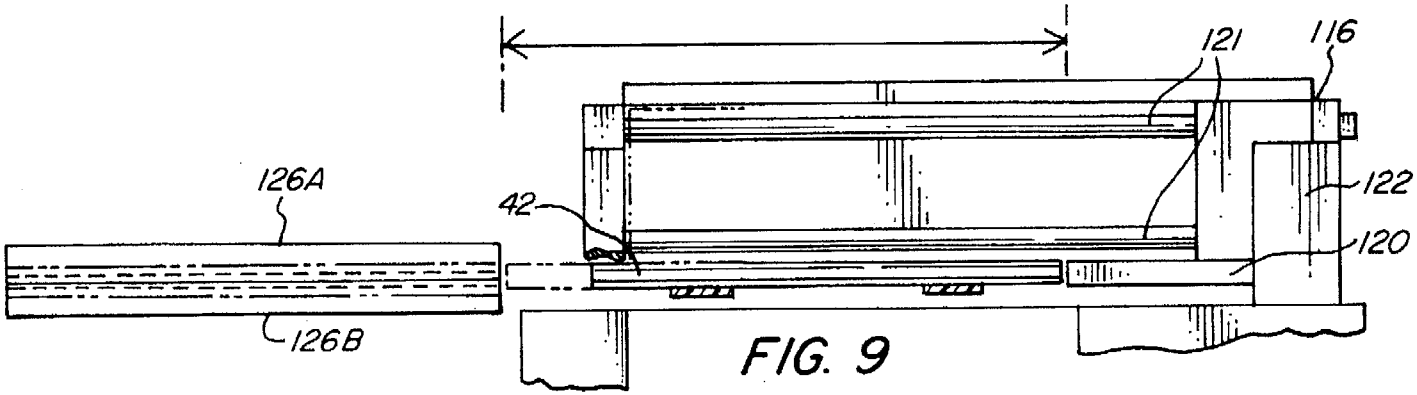
FIG. 9 is a fragmentary front elevational view of the cross slide assembly of the present invention for transferring the slip binders from the buffer conveying device to the insertion module.
Figure 10:
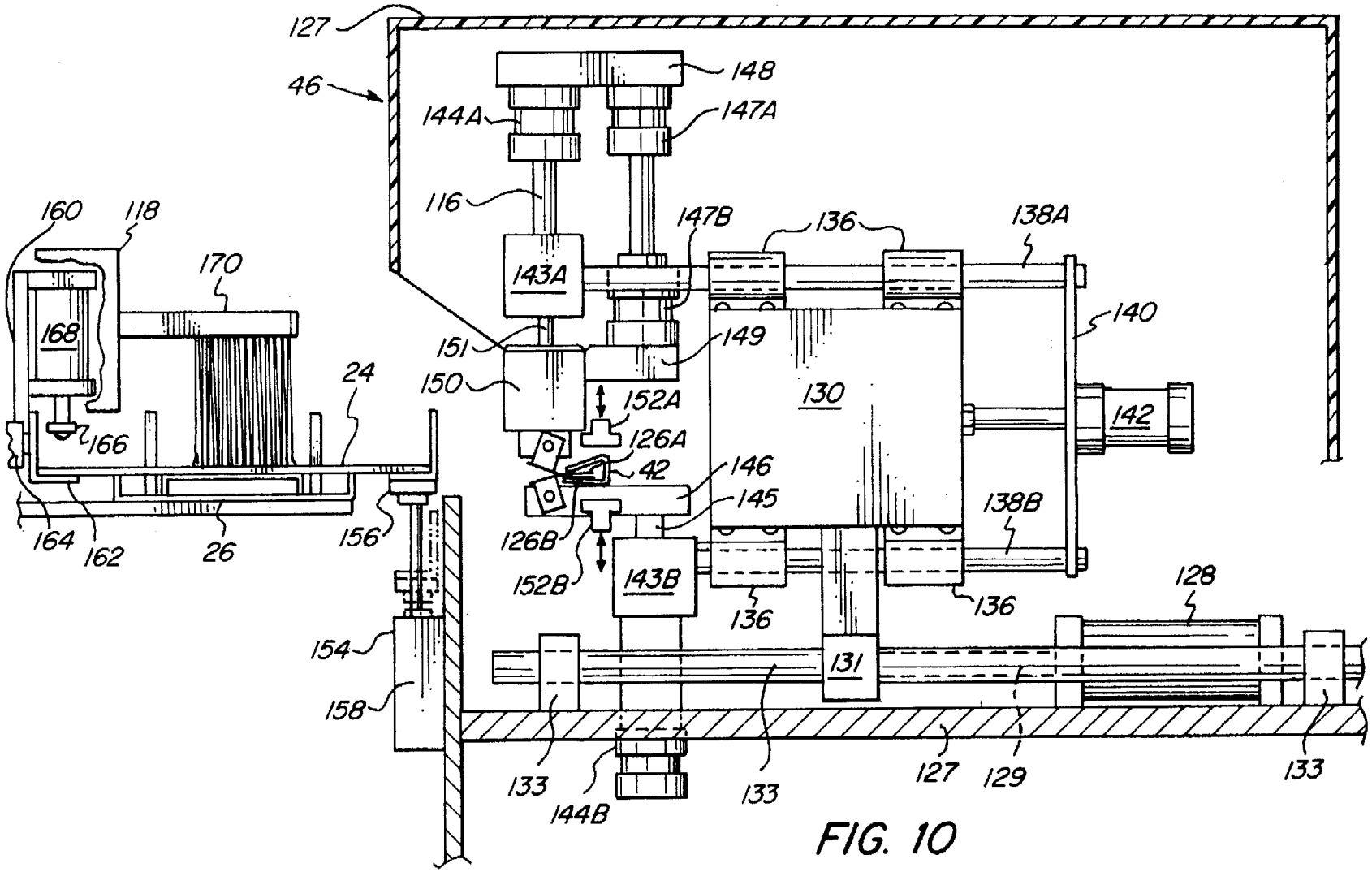
FIG. 10 is a fragmentary side elevational view of the insertion module of the present invention with portions of the housing broken away to illustrate internal structure.

As seen in FIGS. 2, 3, 9 and 10, the insertion module 46 accepts each slip binder 42 at the end of the endless belt conveyor 92 by means of a cross slide assembly 114 of the buffer conveying device 44 which engages the slip binder 42 to transfer it to a slip binder inserter 116 for insertion on the document 24 positioned on a document handler 118. The cross slide assembly 114 includes a cross slide pusher block 120 slidably mounted on a pair of rails 121 (FIG. 9) to engage the slip binder 42 located at the end of the endless belt conveyor 92 opposite the hopper device 40 and move it laterally by means of a pneumatic piston-cylinder device 122. The position of the cross slide pusher block 120 is sensed by two magnetic proximity switches 124 (FIG. 3). As best seen in FIGS. 9 and 10, while the slip binder 42 moves laterally from the cross slide assembly 114 to the slip binder inserter 116, it slides over two opposed blades 126A,126B of the slip binder inserter 116 when the two opposed blades 126A,126B are in a slip binder receiving position. After the slip binder 42 is delivered to the slip binder inserter 116, the cross slide pusher block 120 of the cross slide assembly 114 returns to its original position under the influence of the pneumatic piston-cylinder device 122 to await the need to deliver another slip binder 42.

Referring to FIG. 10, the slip binder inserter 116 has an insert housing 127 in which a master pneumatic piston-cylinder device 128 is fixedly mounted. The master pneumatic piston-cylinder device 128 is operationally connected via its piston shaft 129 to a main support 130 through a leg 131 to move the main support 130 relative to the document handler 118 in a horizontal direction. A pair of shafts 132 (only one shown) are fixed to the leg 131 and are guided for horizontal movement via journal blocks 133. The main support 130 has pillow blocks 136 thereon which slidably receive shafts 138A,138B (only one of each shown), all of which are connected to one another by a plate 140. Attached to the plate 140 is a pneumatic piston-cylinder device 142 which is operationally connected to the main support 130 for moving the plate 140 and the shafts 138A,138B connected thereto relative to the document handler 118 in a horizontal direction independent of the horizontal movement provided by the master pneumatic piston-cylinder device 128. Fixed on the end of the shafts 138A,138B opposite the plate 140 are blocks 143A,143B. Pneumatic piston-cylinder devices 144A,144B are mounted to the blocks 143A,143B for moving the opposed blades 126A,126B, respectively, in vertical direction toward and away from each other. In order to provide the vertical movement to the blade 126B, the pneumatic piston-cylinder device 144B is operationally connected via its piston shaft 145 to a block 146 upon which the blade 126B is mounted. In order to provide additional vertical movement to the blade 126A, the pneumatic piston-cylinder device 144A is mounted in parallel to two series-connected pneumatic piston-cylinder devices 147A,147B by a guide shaft 148. The pneumatic piston-cylinder device 147B is fixedly seated upon a block 149 from which a block 150 is cantilevered. The block 150 has the blade 126A mounted thereto. An anti-rotation shaft 151 is slidably received in the block 150 and fixed to the block 143A. Thus, upon operation of any of the pneumatic piston-cylinder devices 144A, 147A or 147B, the block 150 and the blade 126A connected thereto will move vertically along the shaft 151.

Positioned adjacent the opposed blades 126A,126B are upper and lower clamp jaws 152A,152B moveable in a vertical direction relative to the slip binder 42 and the opposed blades 126A,126B by means of pneumatic piston-cylinder devices (not shown) which are affixed to the main support 130.

As will also be appreciated by referring to FIG. 10, the document handler 118 has a support rail assembly 154 with an L-shaped support rail 156 for supporting one side of the document 24 as the document 24 rests on the high speed conveyor 26. The L-shaped support rail 156 is mounted for vertical movement relative to the document 24 as controlled by a pneumatic piston-cylinder device 158. Spaced on the opposite side of the document 24 from the L-shaped support rail 156 is a jog assembly 160 for moving the document 24 horizontally relative to the slip binder inserter 116. The jog assembly 160 includes an L-shaped jog rail 162 operationally connected to a pneumatic piston-cylinder device 164 which moves the jog assembly 160 horizontally relative to the slip binder inserter 116. The jog assembly 160 also has a document clamp 166, including a pneumatic piston-cylinder device 168, which clamps the document 24 after the slip binder 42 is inserted on the document 24 by the slip binder inserter 116. Finally, extending over the document 24 is a brush 170 which provides light pressure on the top of the document 24 to prevent buckling thereof during the insertion of the slip binder 42 thereon.

Figure 11A:
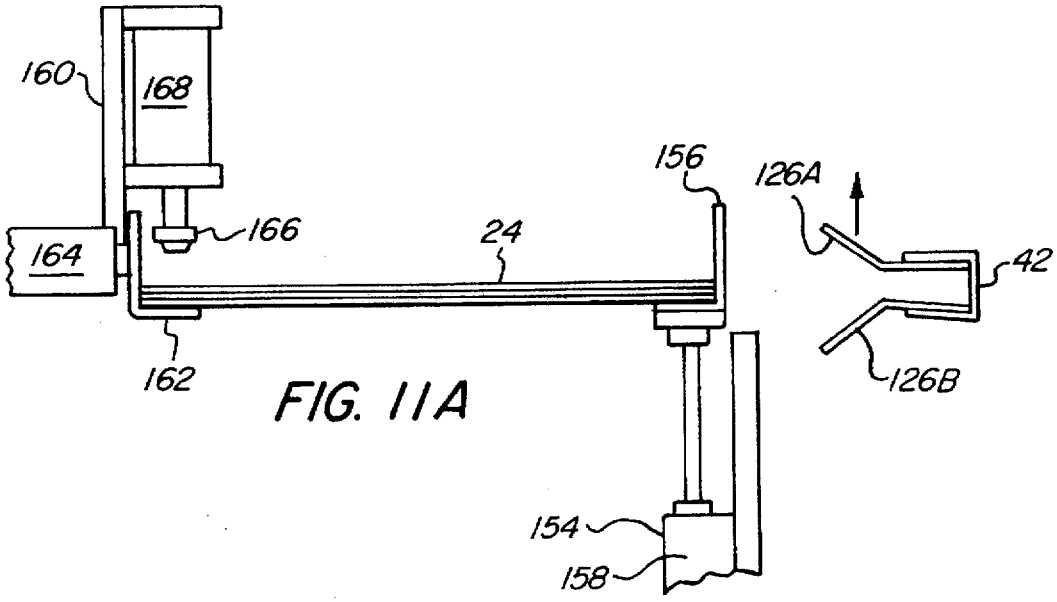
FIGS. 11A–11H are schematic diagrammatic side elevational views showing the sequence of operation of the insertion module feeding a slip binder to bind a document.
Figure 11B:
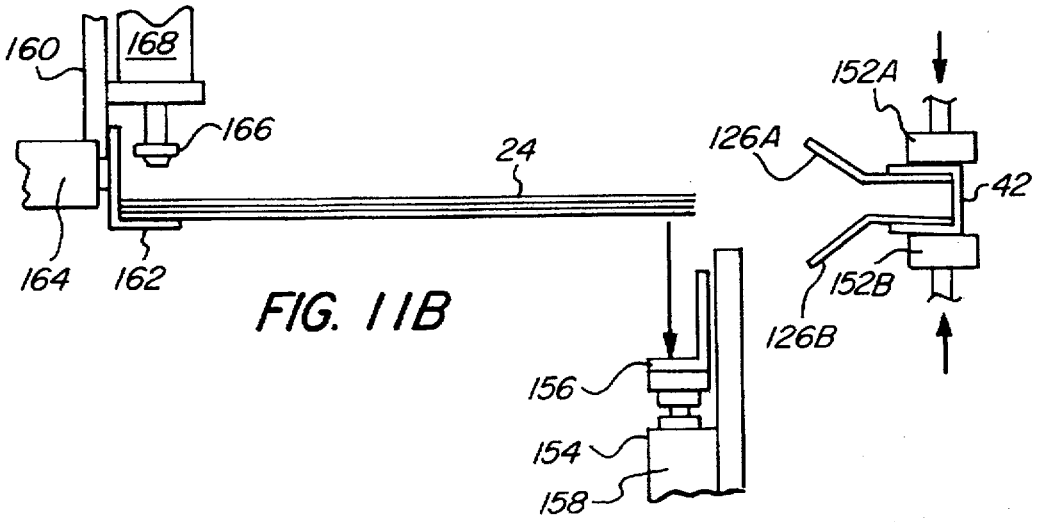
Figure 11C:
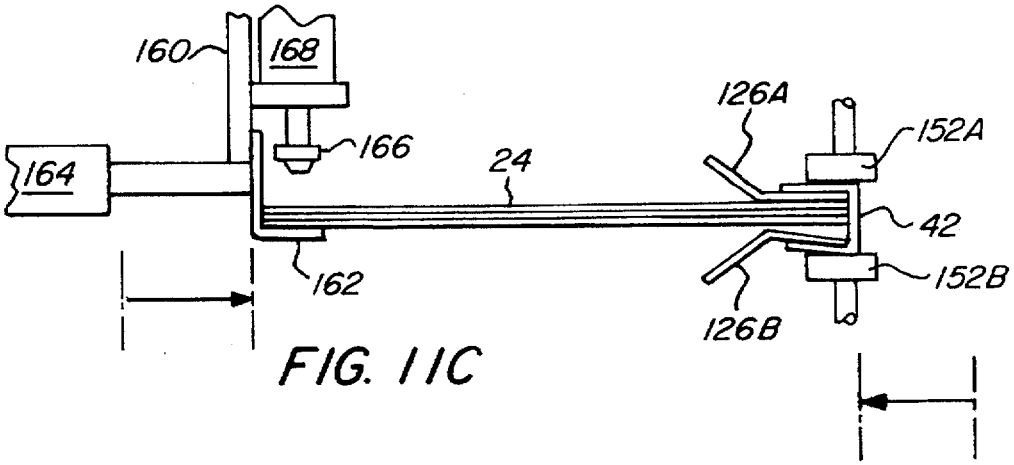
Figure 11D:
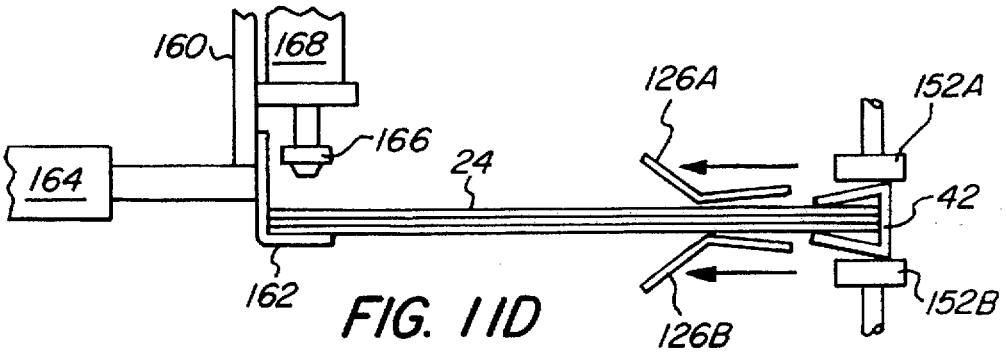
Figure 11E:
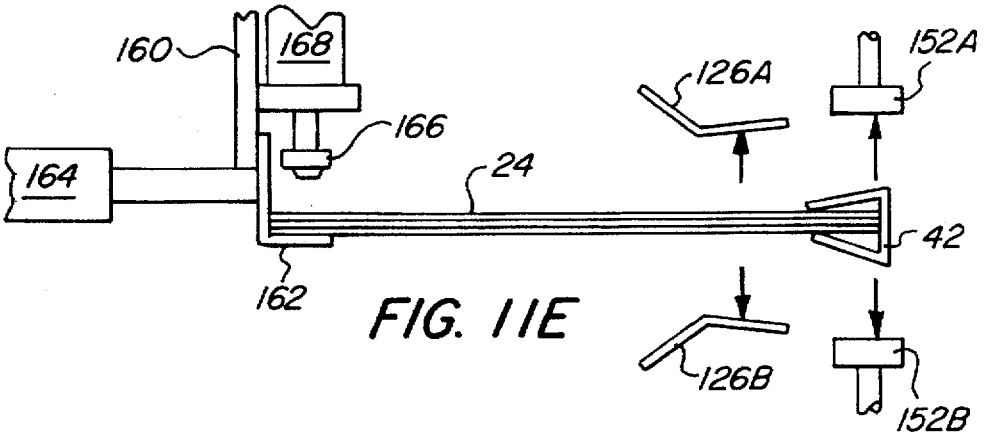
Figure 11F:
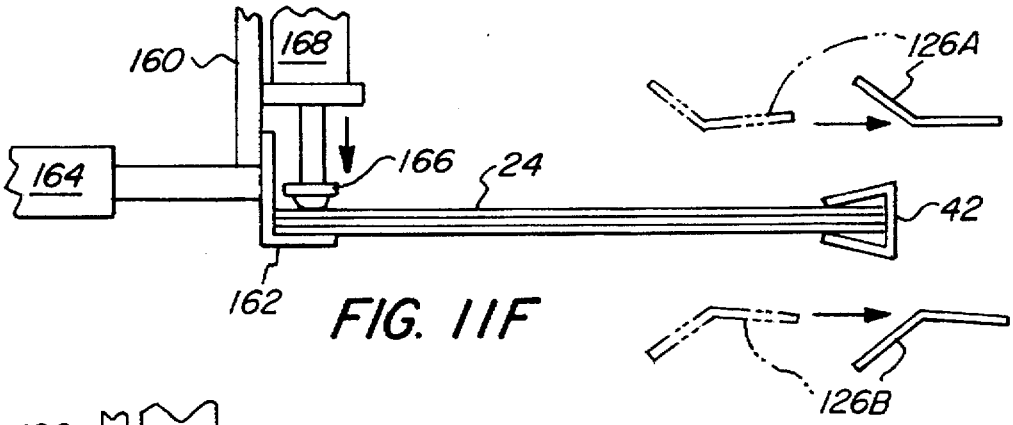
Figure 11G:
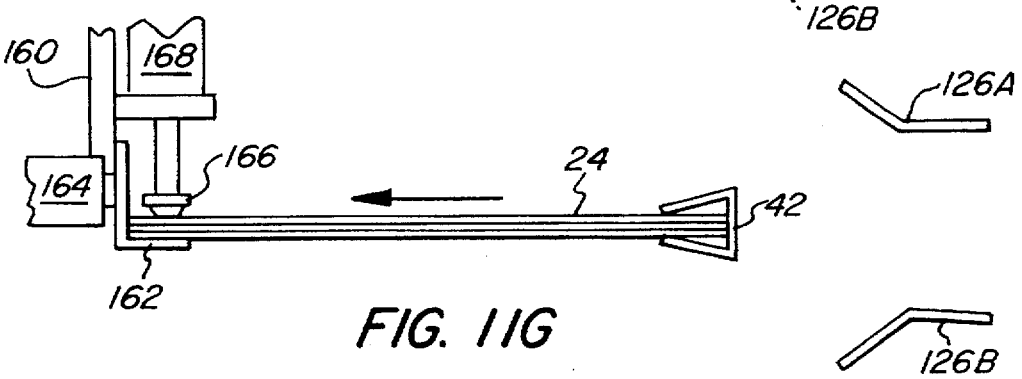
Figure 11H:
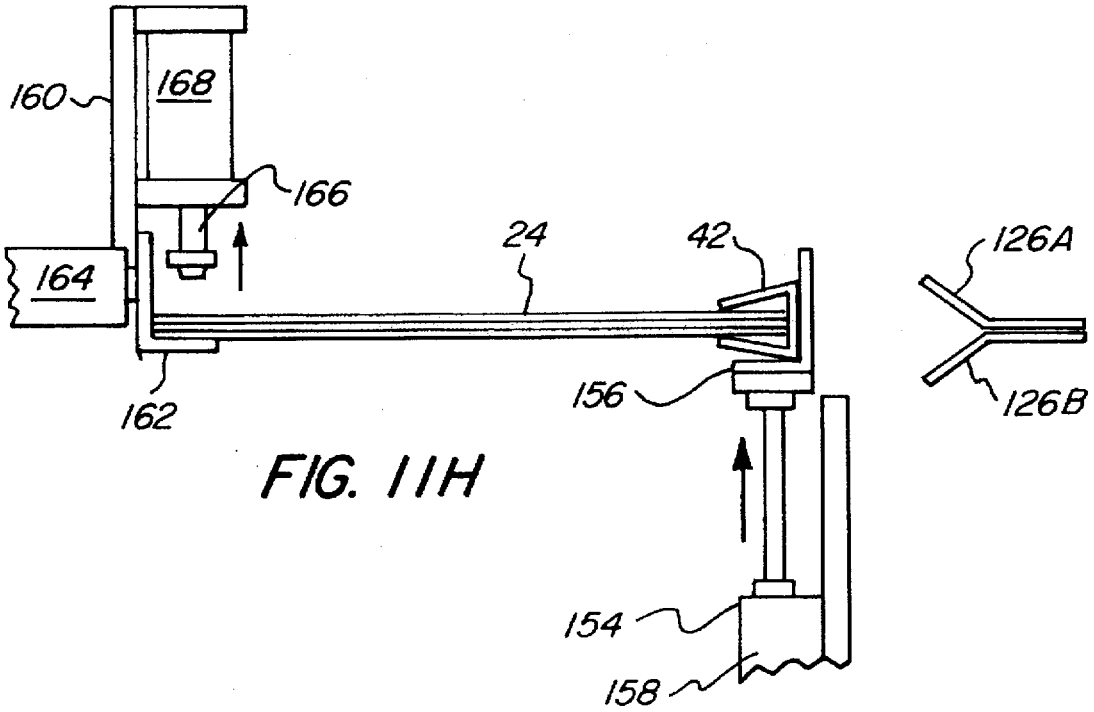

The sequence of operation of the insertion module 46 will be more clearly understood when considering FIGS. 11A–11H. Once the slip binder 42 has been delivered by the cross slide assembly 114 of the buffer conveying device 44 to the opposed blades 126A,126B of the slip binder inserter 116, the blade 126A separates from the blade 126B from the slip binder receiving position to a slip binder insertion position under the action of the pneumatic piston-cylinder device 147B (FIG. 10) to spread the slip binder 42 apart as shown in FIG. 11A. If a large size slip binder (i.e., a slip binder capable of holding sixty (60) sheets of paper) is being fed from the hopper device 39, the pneumatic piston-cylinder device 147A would operate in conjunction with the pneumatic piston-cylinder device 147B to provide a larger vertical movement to the blade 126A thus opening the larger slip binder wider. Next, as shown in FIG. 11B, the pneumatic piston-cylinder device 158 operates to lower the L-shaped support rail 156 while, concurrently, the upper and lower clamp jaws 152A,152B are moved together until they clampingly engage the slip binder 42. In FIG. 11C, the pneumatic piston-cylinder device 164 of the jog assembly 160 operates to move the document 24 toward the slip binder inserter 116 while the master pneumatic piston-cylinder device 128 (FIG. 10) is activated to move the slip binder 42 toward the document handler 118. With the slip binder 42 over the edge of the document 24 as illustrated in FIG. 11D, the pneumatic piston-cylinder device 142 (FIG. 10) initiates further horizontal movement of the opposed blades 126A, 126B until they are clear of the slip binder 42 whereby the slip binder 42 resiliently grips the edge of the document 24. As will be appreciated from FIG. 11E, the opposed blades 126A, 126B can then be moved vertically away from one another and the document 24 under the influence of their respective pneumatic piston-cylinder devices 144A,144B (FIG. 10), while the upper and lower jaws 152A,152B also move vertically away from the slip binder 42 under the influence of their respective pneumatic piston-cylinder devices (not shown). Referring now to FIG. 11F, once the opposed blades 126A,126B are clear of the slip binder 42, the master pneumatic piston-cylinder device 128 (FIG. 10) and pneumatic piston-cylinder device 142 (FIG. 10) operate to move the opposed blades 126A,126B in a horizontal direction while the pneumatic piston-cylinder device 168 initiates a clamping action on the document 24 by the document clamp 166 in cooperation with the L-shaped jog rail 162. The jog assembly 160 then moves the document 24 horizontally as illustrated in FIG. 11G. Finally, in FIG. 11H, the document 24 is unclamped from between the L-shaped jog rail 162 and the document clamp 166, the L-shaped support rail 156 is raised to support the slip binder 42 and the opposed blades 126A,126B are returned to a position adjacent to one another by operation of the pneumatic piston-cylinder devices 144A and 147B (and possibly the pneumatic piston-cylinder device 147A if the hopper device 39 is being used) whereby the document 24 is ready to continue down the high speed conveyor system 26 and the opposed blades 126A,126B are ready to accept the next slip binder 42.

Although not explained in detail, it will be appreciated by those skilled in the art that the slip binder module 12 is event driven and appropriate sensors (e.g. well-known reflective fiber optic sensors) are located throughout the slip binder module 12 to ensure that the various components thereof are in the proper position during each sequence of operation. A computer processing unit (not shown) controls the operation of the entire electronic publishing system 10 including the slip binder module 12 and which of the hopper devices 39,40 will be actuated. This arrangement provides a fail safe system whereby damage to the machine is prevented and quality of the final products is assured.

It should also be understood that, although not shown in the drawings for reasons of clarity of illustration, the various pneumatic piston-cylinder devices used in connection with the invention are provided with flexible couplings in a well-known manner to account for manufacturing tolerances and any misalignment thereof.

Thus, artisans skilled in the art will appreciate that the slip binder module 12 of the present invention as described herein can be employed advantageously to feed slip binders 42 from the reservoir 50 of the hopper devices 39,40 to the buffer conveying device 44 then to the insertion module where the slip binders 42 are inserted onto documents 24 in an efficient and convenient manner. It will, therefore, be seen from the above that the invention described admirably achieves the objects of the invention. However, it will be appreciated that departures can be made by those skilled in the art without departing from the spirit and scope of the invention, which is limited only by the following claims.

Having thus described the invention, what is claimed is:

1. A binding apparatus for binding documents composed of a stacks of sheets, said binding apparatus comprising:

(a) a conveying device for delivering from a plurality of resilient slip binders one sequentially delivered slip binder at a time; and (b) an insertion device for receiving each sequentially delivered slip binder from said conveying device and inserting each sequentially delivered slip binder on its associated document to be bound, said inserting device comprising:

(i) a spreading device for opening each sequentially delivered slip binder along its entire length to an open position greater than a thickness of its associated document to be bound, maintaining each sequentially delivered slip binder in its open position along its entire length until insertion thereof over its associated document to be bound and releasing each sequentially delivered slip binder from its open position onto its associated document to be bound, and (ii) an inserter for relatively moving said spreading device with each sequentially delivered slip binder thereon and its associated document to be bound to insert said sequentially delivered slip binder in its open position over its associated document to be bound, whereupon said spreading device releases each sequentially delivered slip binder from its open position onto its associated document to be bound.

2. The binding apparatus in accordance with claim 1, wherein said spreading device includes two opposed blades positionable in a slip binder receiving position for receiving each sequentially delivered slip binder thereover from said conveying device and means to move said opposed blades relative to each other into a slip binder insertion position thereby opening said sequentially delivered slip binder to permit insertion thereof over its associated document to be bound by said inserter.

3. The binding apparatus in accordance with claim 2, wherein said insertion device further comprises:

means to separate said opposed blades from said sequentially delivered slip binder following insertion of said sequentially delivered slip binder on its associated document to be bound by said inserter whereby said sequentially delivered slip binder binds its associated document.

4. The binding apparatus in accordance with claim 3, wherein said separation means includes means to return said opposed blades to the slip binder receiving position to receive each sequentially delivered slip binder following operation of said separation means.

5. The binding apparatus in accordance with claim 3, wherein said insertion device further comprises a clamping device cooperating with said opposed blades for holding said sequentially delivered slip binder during operation of inserter.

6. The binding apparatus in accordance with claim 5, wherein said clamping device has two relatively moveable opposed clamping jaws which engage said sequentially delivered slip binder.

7. A binding apparatus for binding documents composed of a stacks of sheets, said binding apparatus comprising:

(a) a conveying device for delivering from a plurality of resilient slip binders one sequentially delivered slip binder at a time; and (b) an insertion device for receiving each sequentially delivered slip binder from said conveying device and inserting each sequentially delivered slip binder on its associated document to be bound, said inserting device comprising:

(i) a spreading device for opening each sequentially delivered slip binder to permit insertion thereof on its associated document to be bound, (ii) an inserter for relatively moving each sequentially delivered slip binder and its associated document to be bound to insert said sequentially delivered slip binder over its associated document to be bound, and (iii) a clamping device cooperating with said spreading device for holding said sequentially delivered slip binder during operation of said inserter.

8. The binding apparatus in accordance with claim 7, wherein said clamping device has two relatively moveable opposed clamping jaws which engage said sequentially delivered slip binder.

9. The binding apparatus in accordance with claim 1, wherein said inserter includes a document handler for relatively moving each sequentially delivered slip binder and its associated document.

10. The binding apparatus in accordance with claim 9, wherein said document handler includes a pusher device for relatively moving each sequentially delivered slip binder and its associated document to be bound to insert said sequentially delivered slip binder over its associated document to be bound.

11. The binding apparatus in accordance with claim 10, wherein said pusher device has a document clamp for holding the document to be bound following insertion of said sequentially delivered slip binder thereon.

12. The binding apparatus in accordance with claim 11, wherein said document handler includes a moveable support for supporting at least a portion of the document to be bound.

13. The binding apparatus in accordance with claim 12, wherein said moveable support is positioned to support an edge of the document to receive said sequentially delivered slip binder.

14. The binding apparatus in accordance with claim 9, wherein said document handler includes a moveable support for supporting at least a portion of the document to be bound.

15. The binding apparatus in accordance with claim 14, wherein said moveable support is positioned to support an edge of the document to receive said sequentially delivered slip binder.

16. The binding apparatus in accordance with claim 1, wherein said conveying device has a hopper device for feeding the plurality of resilient slip binders one sequentially delivered slip binder at a time to a buffer conveyor which transfers each sequentially delivered slip binder to said insertion device.

17. The binding apparatus in accordance with claim 16, wherein said hopper device provides a reservoir for the plurality of resilient slip binders and means for feeding one sequentially delivered slip binder at a time from said reservoir to said buffer conveyor.

18. The binding apparatus in accordance with claim 17, wherein said feeding means includes a rotary drum with an orientation slot therein into which one sequentially delivered slip binder at a time can orientate itself from said reservoir for delivery to said buffer conveyor.

19. The binding apparatus in accordance with claim 18, wherein said feeding means includes an abutment plate adjacent to said rotary drum for preventing delivery of an incorrectly orientated slip binder in said orientation slot.

20. The binding apparatus in accordance with claim 19, wherein said feeding means further comprises a diverter for transferring each sequentially delivered slip binder from said orientation slot to said buffer conveyor.

21. The binding apparatus in accordance with claim 20, wherein said diverter defines a chute for guiding each sequentially delivered slip binder from said orientation slot to said buffer conveyor.

22. The binding apparatus in accordance with claim 18, wherein said feeding means further comprises a diverter for transferring each sequentially delivered slip binder from said orientation slot to said buffer conveyor.

23. The binding apparatus in accordance with claim 22, wherein said diverter defines a chute for guiding each sequentially delivered slip binder from said orientation slot to said buffer conveyor.

24. The binding apparatus in accordance with claim 16, wherein said hopper device operates to move a sequentially delivered slip binder to said buffer conveyor upon delivery of a sequentially delivered slip binder to said insertion device by said buffer conveyor.

25. The binding apparatus in accordance with claim 16, wherein said buffer conveyor includes a buffer device for temporarily storing at least two sequentially delivered slip binders to await delivery to an incrementally driven conveyor which transfers each sequentially delivered slip binder to said insertion device.

26. The binding apparatus in accordance with claim 25, wherein said buffer device has a pusher for moving each sequentially delivered slip binder between first, second and third buffer positions and from the third buffer position to said incrementally driven conveyor.

27. The binding apparatus in accordance with claim 26, wherein the first buffer position is located on said pusher and said pusher is reciprocally driven to permit each sequentially delivered slip binder to fall from said pusher so said pusher can move each sequentially delivered slip binder to the second and third buffer positions and to said incrementally driven conveyor.

28. The binding apparatus in accordance with claim 27, wherein said pusher is reciprocally driven to move a sequentially delivered slip binder in the third position to said incrementally driven conveyor upon delivery of a sequentially delivered slip binder to said insertion device by said incrementally driven conveyor.

29. The binding apparatus in accordance with claim 16, wherein said buffer conveyor includes an incrementally driven conveyor and a cross slide assembly for moving each sequentially delivered slip binder from said incrementally driven conveyor to said inserting device.

30. The binding apparatus in accordance with claim 29, wherein said cross slide assembly has a reciprocally driven pusher block for engaging each sequentially delivered slip binder and moving each sequentially delivered slip binder laterally to said spreading device.

31. The binding apparatus in accordance with claim 30, wherein said spreading device includes two opposed blades in a slip binder receiving position for receiving each sequentially delivered slip binder thereover as said pusher block moves each sequentially delivered slip binder laterally to said spreading device.

32. A conveying device for delivering, from a plurality of resilient slip binders, one sequentially delivered slip binder at a time, said conveying device comprises:

(a) a hopper device for feeding the plurality of resilient slip binders one sequentially delivered slip binder at a time, said hopper device provides a reservoir for the plurality of resilient slip binders and means for feeding one sequentially delivered slip binder at a time from said reservoir, said feeding means includes a rotary drum with an orientation slot therein into which one sequentially delivered slip binder at a time can orientate itself from said reservoir for delivery to a conveyor; and (b) a conveyor adjacent to said hopper device for receiving each sequentially delivered slip binder from said hopper device.

33. The conveying device in accordance with claim 32, wherein said feeding means includes an abutment plate adjacent to said rotary drum for preventing delivery of an incorrectly orientated slip binder in said orientation slot.

34. The conveying device in accordance with claim 33, wherein said feeding means further comprises a diverter for transferring each sequentially delivered slip binder from said orientation slot to said conveyor.

35. The conveying device in accordance with claim 34, wherein said diverter defines a chute for guiding each sequentially delivered slip binder from said orientation slot to said conveyor.

36. The conveying device in accordance with claim 32, wherein said feeding means further comprises a diverter for transferring each sequentially delivered slip binder from said orientation slot to said conveyor.

37. The conveying device in accordance with claim 36, wherein said diverter defines a chute for guiding each sequentially delivered slip binder from said orientation slot to said conveyor.

38. The binding apparatus in accordance with claim 32, wherein said conveyor is an intermittently operating conveyor and said hopper device operates in response to operation of said intermittently operating conveyor to feed each sequentially delivered slip binder thereto to space them along said intermittently operating conveyor.

39. The conveying device in accordance with claim 38, wherein said conveyor includes a buffer device for temporarily storing at least two sequentially delivered slip binders to await delivery to said intermittently operating conveyor.

40. The conveying device in accordance with claim 39, wherein said buffer device has a pusher for moving each sequentially delivered slip binder between first, second and third buffer positions and from the third buffer position to said incrementally driven conveyor.

41. The conveying device in accordance with claim 40, wherein the first buffer position is located on said pusher and said pusher is reciprocally driven to permit each sequentially delivered slip binder to fall from said pusher so said pusher can move each sequentially delivered slip binder to the second and third buffer positions and to said incrementally driven conveyor.

42. The conveying device in accordance with claim 41, wherein said pusher is reciprocally driven to move a sequentially delivered slip binder in the third position to said incrementally driven conveyor following each operation of said incrementally driven conveyor.

43. The conveying device in accordance with claim 32, wherein said conveyor includes an incrementally driven conveyor and a cross slide assembly for moving each sequentially delivered slip binder from said endless conveyor.

44. The conveying device in accordance with claim 43, wherein said cross slide assembly has a reciprocally driven pusher block for engaging each sequentially delivered slip binder and moving each sequentially delivered slip binder laterally from the incrementally driven conveyor.

45. The binding apparatus in accordance with claim 1, wherein said spreading device includes means to adjust the open position of each sequentially delivered slip binder whereby different thicknesses of associated documents can be bound.

* * * * *